US009854954B2

(12) United States Patent
Han et al.

(10) Patent No.: US 9,854,954 B2
(45) **Date of Patent: *Jan. 2, 2018**

(54) ROBOT CLEANER

(71) Applicant: SAMSUNG ELECTRONICS CO., LTD., Suwon-si, Gyeonggi-do (KR)

(72) Inventors: Seung Il Han, Sosa-gu (KR); Dong Won Kim, Hwaseong (KR); Sang Sik Yoon, Suwon (KR); Jun Hwa Lee, Suwon-si (KR); Hwi Chan Jang, Yongin (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 189 days.

This patent is subject to a terminal disclaimer.

(21) Appl. No.: 14/731,609

(22) Filed: Jun. 5, 2015

(65) Prior Publication Data

US 2015/0265122 A1 Sep. 24, 2015

Related U.S. Application Data

(63) Continuation of application No. 13/628,915, filed on Sep. 27, 2012, now Pat. No. 9,078,552.

(30) Foreign Application Priority Data

Oct. 6, 2011 (KR) ..... 10-2011-0101852

(51) Int. Cl.
*A47L 9/28* (2006.01)
*A47L 11/24* (2006.01)
(Continued)

(52) U.S. Cl.
CPC ..... *A47L 11/24* (2013.01); *A47L 9/00* (2013.01); *A47L 11/40* (2013.01);
(Continued)

(58) Field of Classification Search
CPC .. A47L 11/24; A47L 11/4061; A47L 11/4055; A47L 11/4038; A47L 11/4069;
(Continued)

(56) References Cited

U.S. PATENT DOCUMENTS 9,078,552 B2 * 7/2015 Han ..... A47L 9/00
2006/0236492 A1 10/2006 Sudo
(Continued)

FOREIGN PATENT DOCUMENTS

CN 2479913 3/2002
CN 1575731 2/2005
(Continued)

OTHER PUBLICATIONS

Chinese Office Action dated Aug. 23, 2016 in corresponding Chinese Patent Application No. 201210377947.5.
(Continued)

*Primary Examiner* — David Redding
(74) *Attorney, Agent, or Firm* — Staas & Halsey LLP

(57) ABSTRACT

The robot cleaner includes a main body configured to remove dust from a floor while traveling on the floor, the main body having a lateral rim defining the external appearance of a lateral surface of the robot cleaner, and at least one side brush assembly mounted to the main body to clean the corner of the floor. The side brush assembly includes a side arm pivotably coupled to the main body, the side arm moving between a first position where the side arm is inserted into the main body and a second position where the side arm protrudes outward from the lateral rim of the main body, a brush unit provided at the side arm to sweep the floor, and a rim cover coupled to the side arm to form a part of the lateral rim of the main body when the side arm is inserted into the main body.

14 Claims, 16 Drawing Sheets

(51) Int. Cl.

| | |
|---|---|
| ***A47L 9/00*** | (2006.01) |
| ***A47L 11/40*** | (2006.01) |
| *A47L 9/04* | (2006.01) |

(52) U.S. Cl.
CPC ..... *A47L 11/4036* (2013.01); *A47L 11/4038* (2013.01); *A47L 11/4055* (2013.01); *A47L 11/4058* (2013.01); *A47L 11/4061* (2013.01); *A47L 11/4069* (2013.01); *A47L 9/0488* (2013.01); *A47L 2201/00* (2013.01)

(58) Field of Classification Search
CPC .. A47L 11/4058; A47L 11/4036; A47L 11/40; A47L 9/00; A47L 9/0488; A47L 2201/00; A47L 9/28
See application file for complete search history.

(56) References Cited

U.S. PATENT DOCUMENTS

| | | | |
|---|---|---|---|
| 2010/0037418 | A1 | 2/2010 | Hussey et al. |
| 2011/0239382 | A1 | 10/2011 | Lee et al. |
| 2012/0090133 | A1 | 4/2012 | Kim et al. |

FOREIGN PATENT DOCUMENTS

| | | |
|---|---|---|
| JP | 2005-6857 | 1/2005 |
| JP | 2011-45694 | 3/2011 |
| KR | 10-2006-0048846 | 5/2006 |
| KR | 10-2009-0033608 | 4/2009 |

OTHER PUBLICATIONS

Office Action dated Dec. 15, 2015 in Australian Patent Application No. 2012319325.
Office Action dated Dec. 22, 2015 in Chinese Patent Application No. 201210377947.5.
U.S. Office Action dated Dec. 19, 2014 for co-pending U.S. Appl. No. 13/628,915.
U.S. Notice of Allowance dated Mar. 5, 2015 for co-pending U.S. Appl. No. 13/628,915.
Australian Patent Examination Report No. 1 dated Apr. 16, 2015 in corresponding Australian Patent Application No. 2012319325.
U.S. Appl. No. 13/628,915, filed Sep. 27, 2012, Seung Ill Han et al., Samsung Electronics Co., Ltd.
Chinese Decision on Grant and Registration dated Feb. 20, 2017 in corresponding Chinese Application No. 201210377947.5.
Korean Office Action dated Jun. 30, 2017 in corresponding Korean Patent Application No. 10-2011-0101852.

* cited by examiner

ROBOT CLEANER

CROSS-REFERENCE TO RELATED APPLICATIONS

This application is a continuation application of U.S. Ser. No. 13/628,915 filed in the United States on Sep. 27, 2012, which claims the benefit of Korean Patent Application No. 10-2011-0101852, filed on Oct. 6, 2011 in the Korean Intellectual Property Office, the disclosure of which is incorporated herein by reference.

BACKGROUND

1. Field

Embodiments of the present disclosure relate to a robot cleaner to achieve enhanced cleaning performance at an area close to the wall or at the corner of the floor.

2. Description of the Related Art

A cleaner is an apparatus that cleans a room by removing impurities. In recent years, a robot cleaner, which removes impurities from an indoor floor while autonomously moving via an automated traveling function without user intervention, has been actively developed.

More specifically, the robot cleaner is adapted to automatically clean a target area by sucking up impurities, such as dust, from a floor while autonomously traveling about the area to be cleaned without user manipulation.

To this end, the robot cleaner functions to detect a distance from an obstacle, such as furniture, office appliances and walls, present in the cleaning area using a variety of sensors, and to travel without collision with the obstacle based on detected information.

Cleaning a given cleaning area using the robot cleaner means an operation in which the robot cleaner repeatedly performs a cleaning operation while traveling in the cleaning area based on a preset traveling pattern.

The robot cleaner performs a cleaning operation while automatically judging a cleaning area based on signals from a plurality of sensors. The robot cleaner includes a side brush to enhance cleaning performance at an area close to the wall, for example.

The side brush of the robot cleaner is mounted to either side of a main body of the cleaner and is adapted to rotate about a vertical rotating shaft so as to scrape dust, etc. from a floor inward of the main body of the robot cleaner.

However, the side brush could not be fabricated longer than a predetermined length because it is required to impede traveling of the robot cleaner and to not cause interference with other elements arranged at the bottom of the robot cleaner. This results in an area where the side brush does not reach, making it impossible to completely clean the corresponding area, for example, a corner of a floor.

SUMMARY

Therefore, it is one aspect of the present disclosure to provide a robot cleaner having a configuration to ensure that a side brush may even reach the corner of a floor.

It is another aspect to provide a robot cleaner having a configuration in which the length of a side brush may be extended without causing interference with other elements of the robot cleaner.

Additional aspects will be set forth in part in the description which follows and, in part, will be obvious from the description, or may be learned by practice of the invention.

In accordance with one aspect, a robot cleaner includes a main body configured to remove dust from a floor while traveling on the floor, the main body having a lateral rim defining the external appearance of a lateral surface of the robot cleaner, and at least one side brush assembly mounted to the main body to clean the corner of the floor, wherein the side brush assembly includes a side arm pivotably coupled to the main body, the side arm moving between a first position where the side arm is inserted into the main body and a second position where the side arm protrudes outward from the lateral rim of the main body, a brush unit provided at the side arm to sweep the floor, and a rim cover coupled to the side arm to form a part of the lateral rim of the main body when the side arm is inserted into the main body.

The side arm may be pivoted when the main body comes close to the corner of the floor, thereby protruding outward from the lateral rim of the main body to the second position.

The side brush assembly may further include an arm motor provided at an end of the side arm to pivot the side arm.

The brush unit may include a rotator mounted to an end of the side arm to enable pivoting of the side arm, and a plurality of brushes extending outward in a radial direction from the rotator.

The brush unit may further include a brush motor provided at the end of the side arm to enable rotation of the rotator.

When one side of the main body comes close to a wall, the side arm of the side brush assembly closest to the wall may protrude outward from the lateral rim of the main body to move to the second position.

When a front end of the main body on the basis of a traveling direction comes close to a wall, the side arm of the at least one side brush assembly located at the front end of the main body may protrude outward from the lateral rim of the main body to move to the second position.

In accordance with another aspect, a robot cleaner includes a main body configured to remove dust from a floor while traveling on the floor, the main body having a lateral rim defining the external appearance of a lateral surface of the robot cleaner, and an opening formed in the lateral rim, and a plurality of side brush assemblies arranged at opposite sides of a front surface of the main body on the basis of a traveling direction, wherein the plurality of side brush assemblies each includes a side arm pivotably coupled to the main body, the side arm moving through the opening of the main body between a position where the side arm is inserted into the main body and a position where the side arm protrudes outward from the lateral rim of the main body, a brush unit provided at the side arm to sweep the floor, and a rim cover configured to cover the opening when the side arm moves to the position where it is inserted into main body.

When the main body comes close to the corner of the floor, the side arm may be pivoted to the position where the side arm protrudes outward from the lateral rim of the main body, and the rim cover may open the opening of the main body.

The plurality of side brush assemblies may include a left side brush assembly provided at the left side of the front surface of the main body, and a right side brush assembly provided at the right side of the front surface of the main body.

When one side of the main body comes close to a wall, the side arm of one side brush assembly closest to the wall among the left side brush assembly and the right side brush assembly may move to the position where the side arm protrudes outward from the lateral rim of the main body.

When a front end of the main body comes close to a wall, the side arm of each of the left side brush assembly and the right side brush assembly may move to the position where the side arm protrudes outward from the lateral rim of the main body.

In accordance with another aspect, a robot cleaner includes a main body configured to clean a floor while traveling on the floor, and at least one side brush assembly mounted to the main body to clean the corner of the floor, wherein the side brush assembly includes an arm holder placed to rotate about a holder shaft, a brush arm coupled to the arm holder so as to move in a radial direction relative to the holder shaft, a brush coupled to the brush arm to sweep the floor, and a brush guide mounted to the main body to guide movement of the brush arm, the brush guide having a rail to guide the brush arm such that the brush arm moves to protrude outward from the main body upon rotation of the arm holder.

The rail may be located to surround the holder shaft, and a part of the rail may protrude outward from a lateral surface of the main body.

The rail may include a peak portion farthest from the holder shaft, and the peak portion of the rail may protrude farther outward from a lateral surface of the main body.

A distance between the rail and the holder shaft may vary based on a rotating direction of the arm holder.

The brush guide may be pivotably mounted to the main body.

The brush guide may be pivoted between a state in which a part of the brush guide protrudes outward from the lateral surface of the main body and a state in which the protruding part is inserted into the main body.

The brush guide may be pivoted and inserted into the main body even if the protruding part of the brush guide bumps into an obstacle, thereby preventing damage to the brush guide.

The robot cleaner may further include an elastic member to elastically bias the brush rail outward from the main body.

In accordance with another aspect, a robot cleaner includes a main body configured to clean a floor while traveling on the floor, and at least one side brush assembly mounted to the main body to clean the corner of the floor, wherein the side brush assembly includes an arm holder placed to rotate about a holder shaft, a brush arm coupled to the arm holder so as to move in a radial direction relative to the holder shaft, a brush coupled to the brush arm to sweep the floor, and a brush guide having a rail to guide the brush arm such that the brush arm moves to protrude outward from the main body upon rotation of the arm holder, and wherein the rail includes a first arc portion located outside the lateral surface of the main body and a second arc portion located inside the main body, and the longest distance between the holder shaft and the first arc portion is greater than a distance between the holder shaft and the second arc portion.

In accordance with another aspect, a robot cleaner includes a main body configured to clean a floor while traveling on the floor, and at least one side brush assembly mounted to the main body to clean the corner of the floor, wherein the side brush assembly includes an arm holder placed to rotate about a holder shaft, a brush arm coupled to the arm holder so as to move in a radial direction relative to the holder shaft, a brush coupled to the brush arm to sweep the floor, and a brush guide having a rail to guide the brush arm such that the brush arm moves to protrude outward from the main body upon rotation of the arm holder, and wherein the rail includes a first arc portion located outside the lateral surface of the main body and a second arc portion located inside the main body, and a radius of curvature of the first arc portion is less than a radius of curvature of the second arc portion.

In accordance with a further aspect, a robot cleaner includes a main body configured to clean a floor while traveling on the floor, and at least one side brush assembly mounted to the main body to clean the corner of the floor, wherein the side brush assembly includes a rotating plate rotatably mounted to the main body, a brush unit having one end coupled to the rotating plate such that the brush unit sweeps dust via pivoting thereof, and a brush guide mounted to the main body to guide movement of the brush unit, and wherein the brush unit moves on a fanlike trajectory while sliding relative to the brush guide.

The brush unit may sweep dust from the front to the rear of the main body when the other end of the brush unit reaches an outside position farthest from the main body while moving on a fanlike trajectory.

The brush guide may include a brush guide support portion and a protrusion protruding from the support portion to guide movement of the brush unit, and the brush unit may include a sliding region into which the protrusion is inserted to enable sliding of the brush unit.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
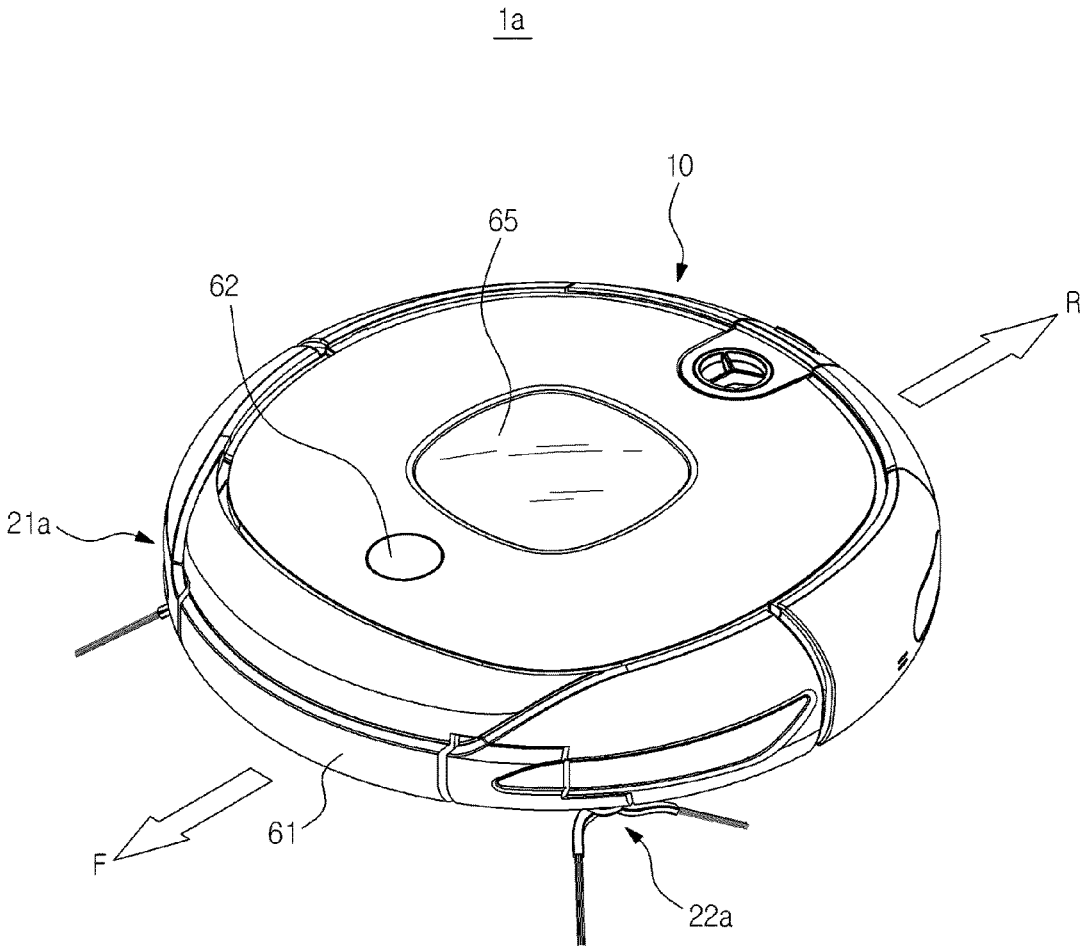
FIG. 1 is a perspective view showing a robot cleaner according to an embodiment.

Reference will now be made in detail to the embodiments of the present disclosure, examples of which are illustrated in the accompanying drawings, wherein like reference numerals refer to like elements throughout.

Figure 2:
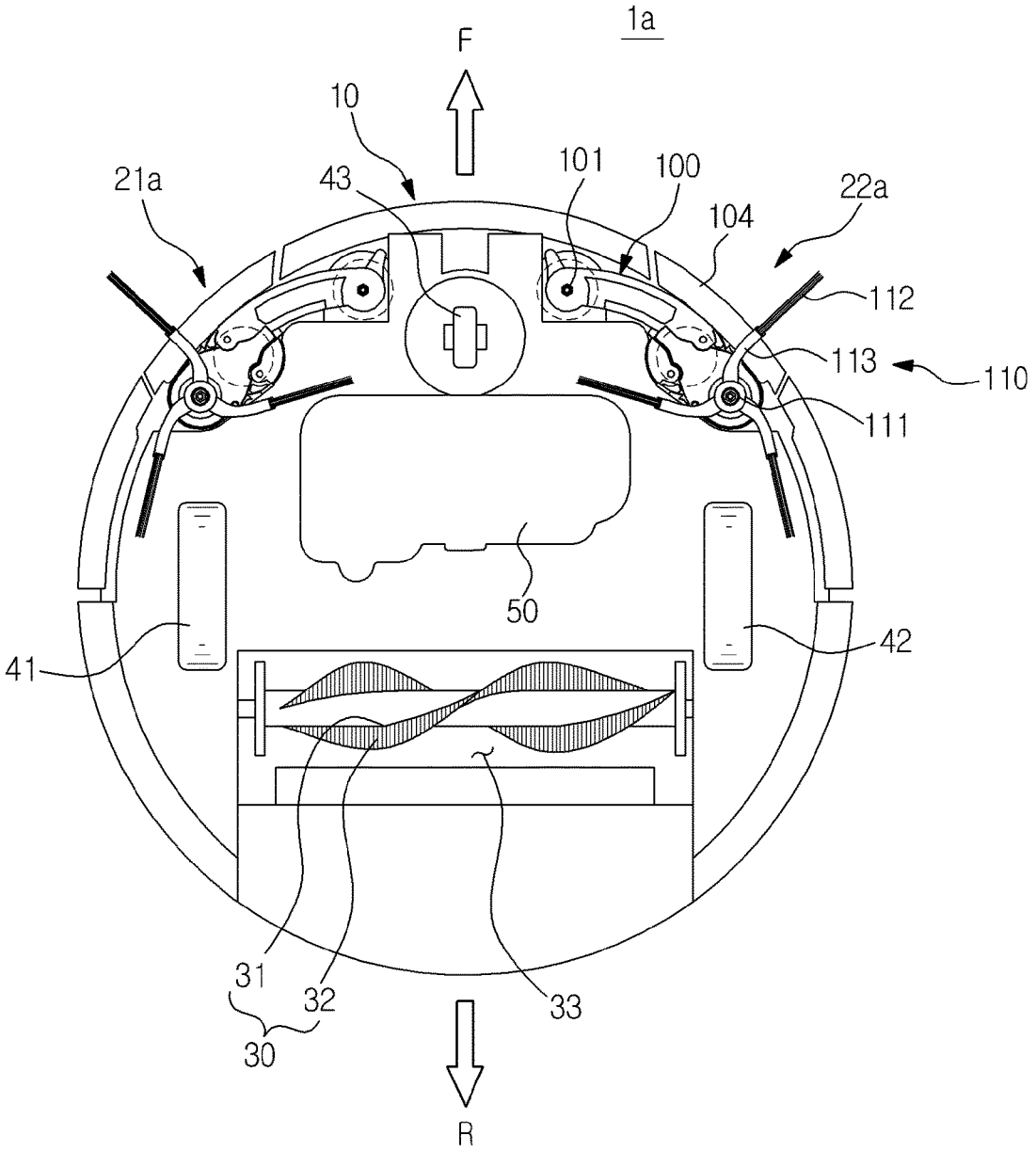
FIG. 2 is a bottom view of the robot cleaner of FIG. 1, showing a state in which a side brush assembly is inserted into a main body.

As shown in FIGS. 1 and 2, a robot cleaner 1*a* includes a main body 10 forming the external appearance of the robot cleaner 1*a*, a main brush unit 30 configured to sweep dust present on a floor and direct the dust to a suction opening, a power unit 50 to supply power required to move the main body 10, drive wheels 41 and 42 and a caster 43 for movement of the main body 10, and side brush assemblies 21*a* and 22*a* to clean an area close to the wall and the corner of the floor.

The two drive wheels 41 and 42 are symmetrically arranged at left and right edges of a bottom center region of the main body 10. These drive wheels enable movements of the main body 10 including, for example, forward and backward traveling and rotation traveling during cleaning.

The caster 43 is mounted at a front bottom edge of the main body 10 on the basis of a traveling direction and assists the main body 10 in maintaining a stable posture. The drive wheels 41 and 42 and the caster 43 constitute a single assembly detachably attached to the main body 10.

The power unit 50 includes a battery that is electrically connected to each drive device to drive the main body 10 and a variety of elements mounted in the main body 10 to supply power. The battery is a rechargeable secondary battery, and is charged with power supplied from a docking station (not shown) when the main body 10 is docked with the docking station (not shown) after completion of a cleaning operation.

The main brush unit 30 is mounted to an opening that is formed at a position deviated rearward from the bottom center region of the main body 10.

The main brush unit 30 serves to sweep dust accumulated on the floor on which the main body 10 is placed. The opening formed in the bottom of the main body 10, to which the main brush unit 30 is mounted, is referred to as a dust inlet opening 33.

The main brush unit 30 includes a roller 31 and a main brush 32 embedded in an outer circumference of the roller 31. As the roller 31 rotates, the main brush 32 sweeps dust accumulated on the floor to direct the dust to the dust inlet opening 33. The roller 31 may be formed of a steel body, but is not limited thereto. The main brush 32 may be formed of various elastic materials.

Although not shown in the drawings, a blowing device to generate suction force is installed inside the dust inlet opening 33, causing the dust introduced through the dust inlet opening 33 to move to a dust collecting device 55.

The main body 10 is provided with a variety of sensors 61 and 62. The sensors 61 and 62 may include a proximity sensor 61 and/or a vision sensor 62. For example, when the robot cleaner 1*a* travels in an arbitrary direction without a predetermined path, that is, in a cleaning system having no map, the robot cleaner 1*a* may travel about a cleaning area using the proximity sensor 61. On the contrary, when the robot cleaner 1*a* travels along a predetermined path, that is, in a cleaning system requiring a map, the vision sensor 62 may be installed to generate a map upon receiving position information on the robot cleaner 1*a*. The vision sensor 62 is one example of a position recognition system, and may be realized in various ways.

A display unit 65 may show a variety of states of the robot cleaner 1*a*. For example, the display unit 65 may show a battery charge state, whether or not the dust collecting device 55 is full of dust, a cleaning mode of the robot cleaner 1*a*, and a dormant mode, for example.

A configuration of the side brush assemblies 21*a* and 22*a* will be described hereinafter.

Figure 3:
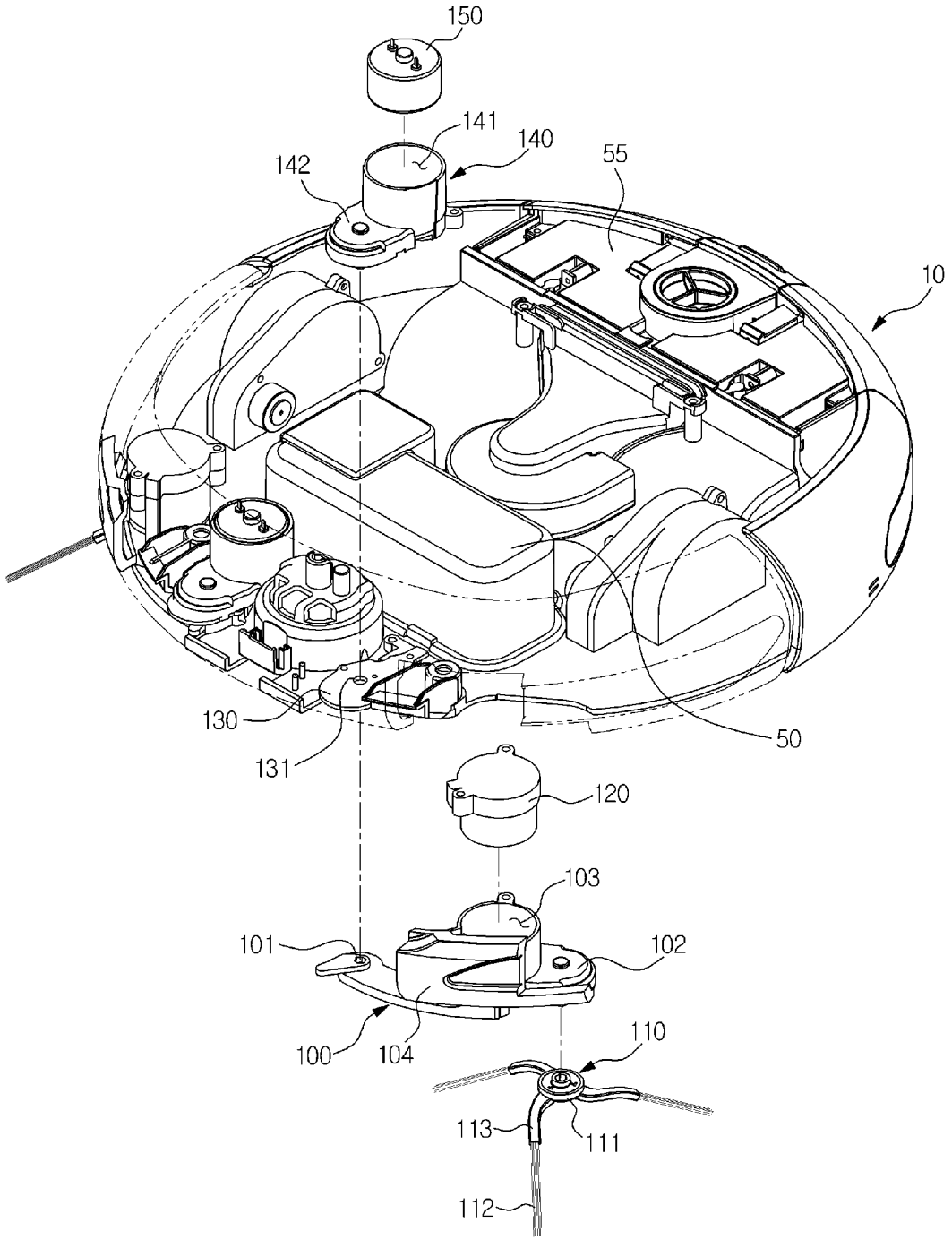
FIG. 3 is a perspective view showing a configuration of the robot cleaner of FIG. 1.

As shown in FIGS. 2 and 3, the main body 10 has openings at front opposite positions thereof, and the side brush assemblies 21*a* and 22*a* are mounted to cover the respective openings.

Each of the side brush assemblies 21*a* and 22*a* includes a side arm 100, and a brush unit 110 rotatably mounted to one end of the side arm 100.

A support piece 130 is provided at a front lateral position of the main body 10. An arm motor housing 140 is coupled to the top of the support piece 130, and the side arm 100 is coupled to the bottom of the support piece 130.

The arm motor housing 140 includes an arm motor receiver 141, in which an arm motor 150 is received.

A first gear receiver 142 is connected to the arm motor receiver 141. The first gear receiver 142 receives a first gear (not shown) that is coupled to the arm motor 150 to transmit power of the arm motor 150 to the side arm 100. A rotating shaft (not shown) connected to the center of the first gear protrudes from a lower end of the first gear receiver 142.

The rotating shaft (not shown) penetrates a through-hole 131 of the support piece 130 and is fitted into a coupling recess 101 formed in one end of the side arm 100. Upon rotation of the rotating shaft, the side arm 100 is pivoted about the coupling recess 101.

The side arm 100 is provided with a brush motor receiver 103 configured to receive a brush motor 120. A second gear receiver 102 is connected to the brush motor receiver 103. The second gear receiver 102 receives a second gear (not shown) to transmit power of the brush motor 120 to the brush unit 110.

One end of a rotating shaft is connected to the center of the second gear (not shown), and the other end of the rotating shaft protrudes from a lower end of the second gear receiver 102.

The protruding end of the rotating shaft is connected to a rotator 111 of the brush unit 110, to allow the rotator 111 to be rotated by power of the brush motor 120.

A brush arm 113 extends outward in a radial direction from the rotator 111. A brush 112 is coupled to the brush arm 113 and serves to sweep dust, etc. present on the floor and collect the dust to the center of the main body 10.

A rim cover 104 is mounted to an outer perimeter of the side arm 100. The rim cover 104 is configured not only to cover the opening formed in the main body 10, but also to constitute a partial lateral rim of the main body 10.

Figure 4:
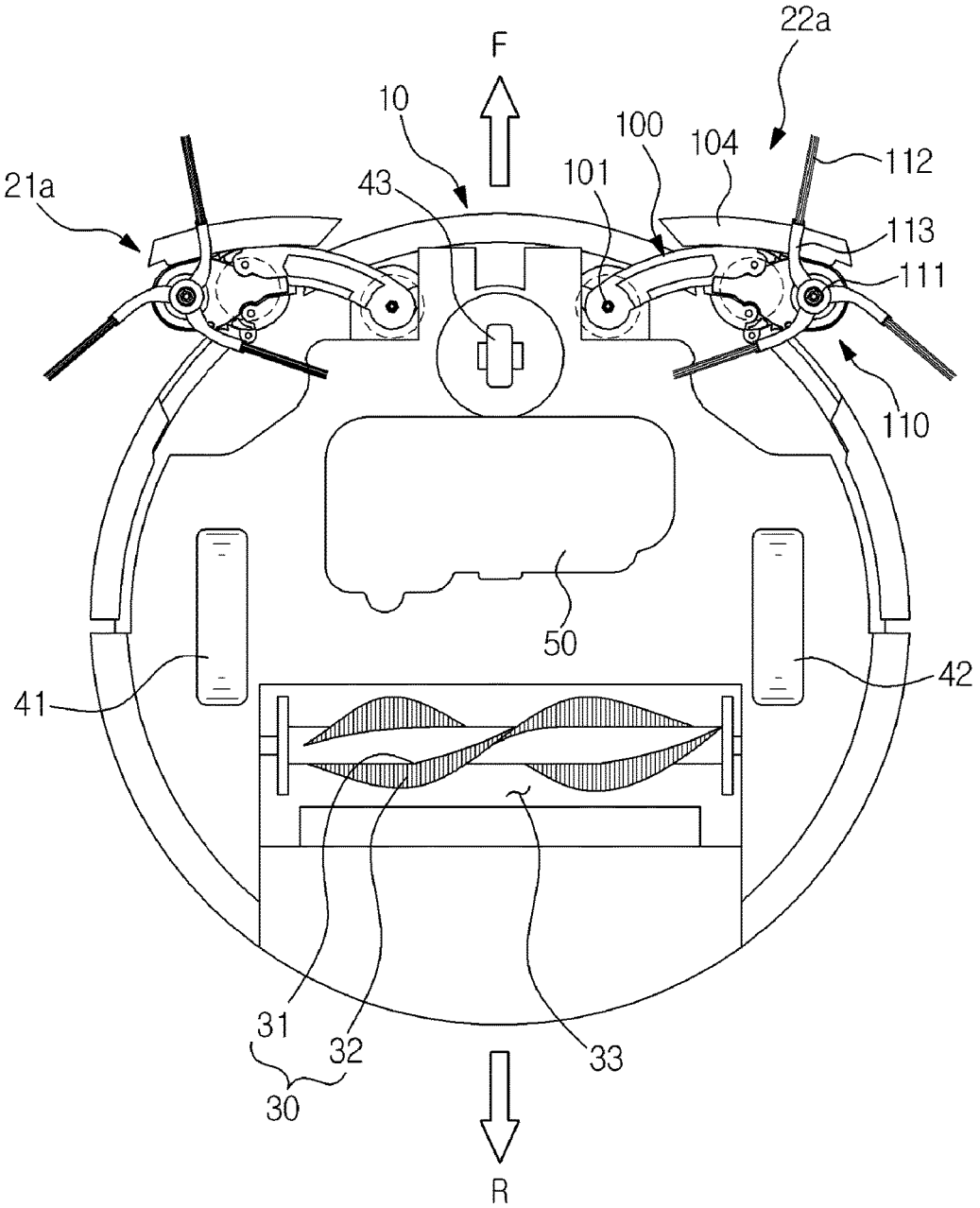
FIG. 4 is a bottom view of the robot cleaner of FIG. 1, showing a state in which a side brush assembly protrudes outward from a main body.

As shown in FIGS. 3 and 4, when the arm motor 120 is rotated, power of the arm motor 120 is transmitted to the side arm 100 via the first gear (not shown), causing the side arm 100 to be pivoted outward of the main body 10.

As the side arm 100 is pivoted, the rim cover 104 no longer covers the opening of the main body 10 and does not constitute the lateral rim of the main body 10.

Since the side arm 100 is rotated about the coupling recess 101, the side brush 110 mounted at an end of the side arm 100 opposite from the coupling recess 101 protrudes outward of the main body 10.

The side brush 110 protruding outward of the main body 10 may achieve an expanded cleaning area, and consequently may clean even the corner of the floor or an area close to the wall.

Hereinafter, operation of the robot cleaner 1*a* will be described.

Figure 5:
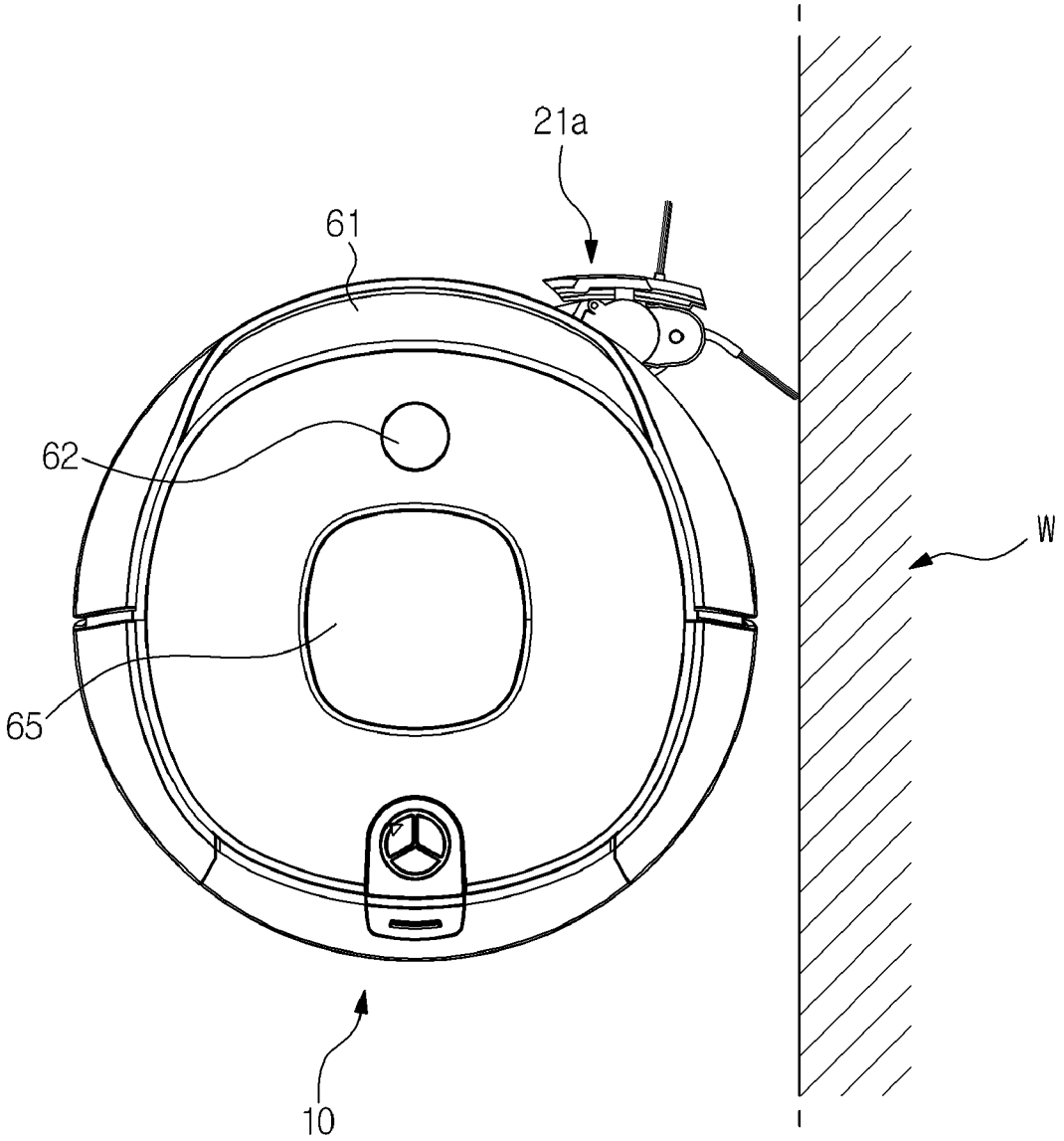
FIGS. 5 and 6 are views showing operation of a side brush assembly in the robot cleaner of FIG. 1.

As shown in FIG. 5, when the right side of the robot cleaner 1*a* is located close to the wall W on the basis of a traveling direction of the robot cleaner 1*a*, the right side brush assembly 21*a* close to the wall W is operated.

As the arm motor 150 of the right side brush assembly 21*a* is rotated, the side arm 100 is pivoted about the coupling recess 101, thereby protruding outward of the main body 10.

When the side arm 100 protrudes outward of the main body 10, the side brush 110 mounted to the end of the side arm 100 may function to clean an area even farther from the main body 10. That is, the side brush 110 may reach even the floor immediately near a lower end of the wall W so as to clean the floor.

Figure 6:
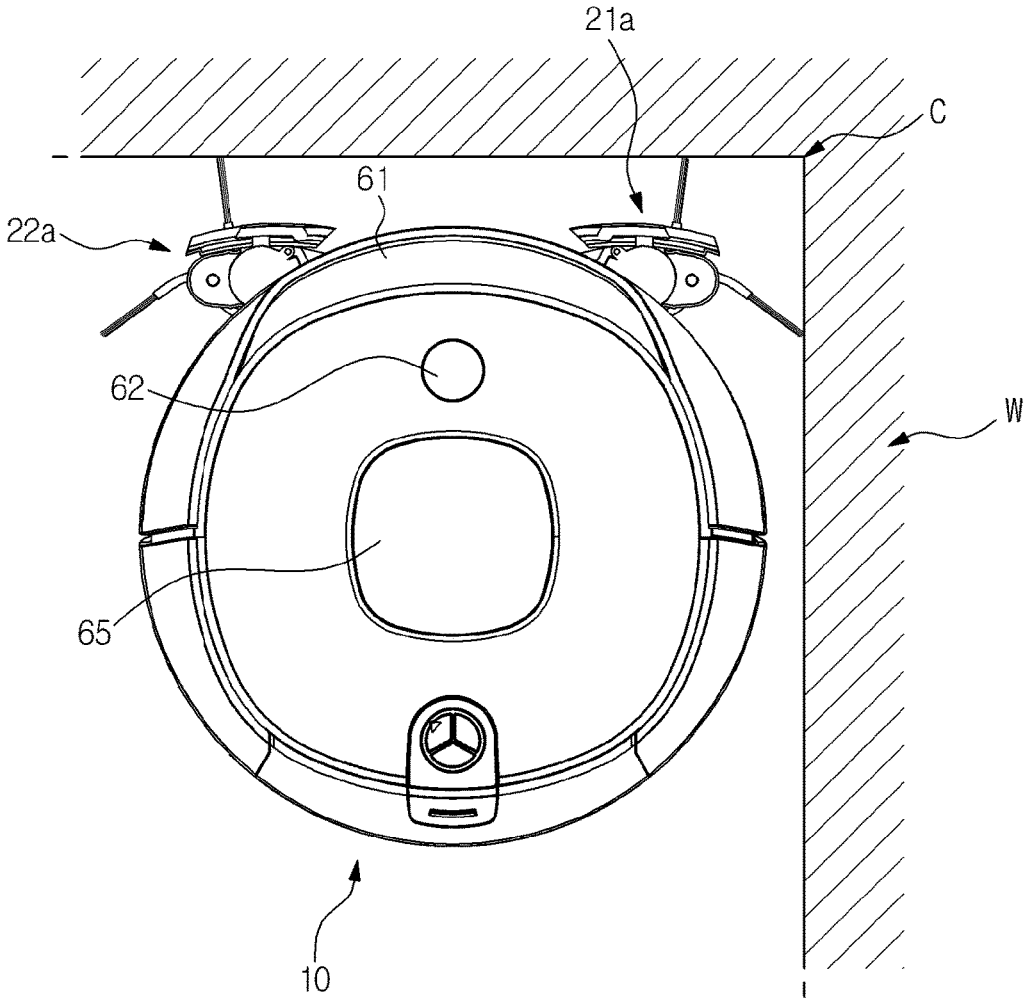

As shown in FIG. 6, when the robot cleaner 1*a* comes close to the corner C of the floor while performing a cleaning operation, both the left side brush assembly 22*a* and the right side brush assembly 21*a* are operated.

The corner C of the floor is a place where two walls meet, and the walls are present at the front side and the left or right side of the main body 10.

The robot cleaner according to the embodiment of the present invention serves to realize easy cleaning of the corner of the floor as well as the area close to the wall.

As such, in the case in which the wall is present at the front side of the main body 10, the two side brush assemblies 21*a* and 22*a* are operated together.

Also, in the case in which the robot cleaner 1*a* comes close to the corner, as described above, the walls are present at both the front side and the lateral side of the main body 10, and thus, the two side brush assemblies 21*a* and 22*a* are operated together.

With simultaneous operation of the two side brush assemblies 21*a* and 22*a*, it may be possible to efficiently clean all the area close to the front wall, the area close to the lateral wall, and the corner of the floor.

Operation of the side brush assemblies 21*a* and 22*a* is equal to the above description, and thus a detailed description thereof will be omitted hereinafter.

A description related to an overlapped configuration with the previously described embodiment will be omitted hereinafter.

Figure 7:
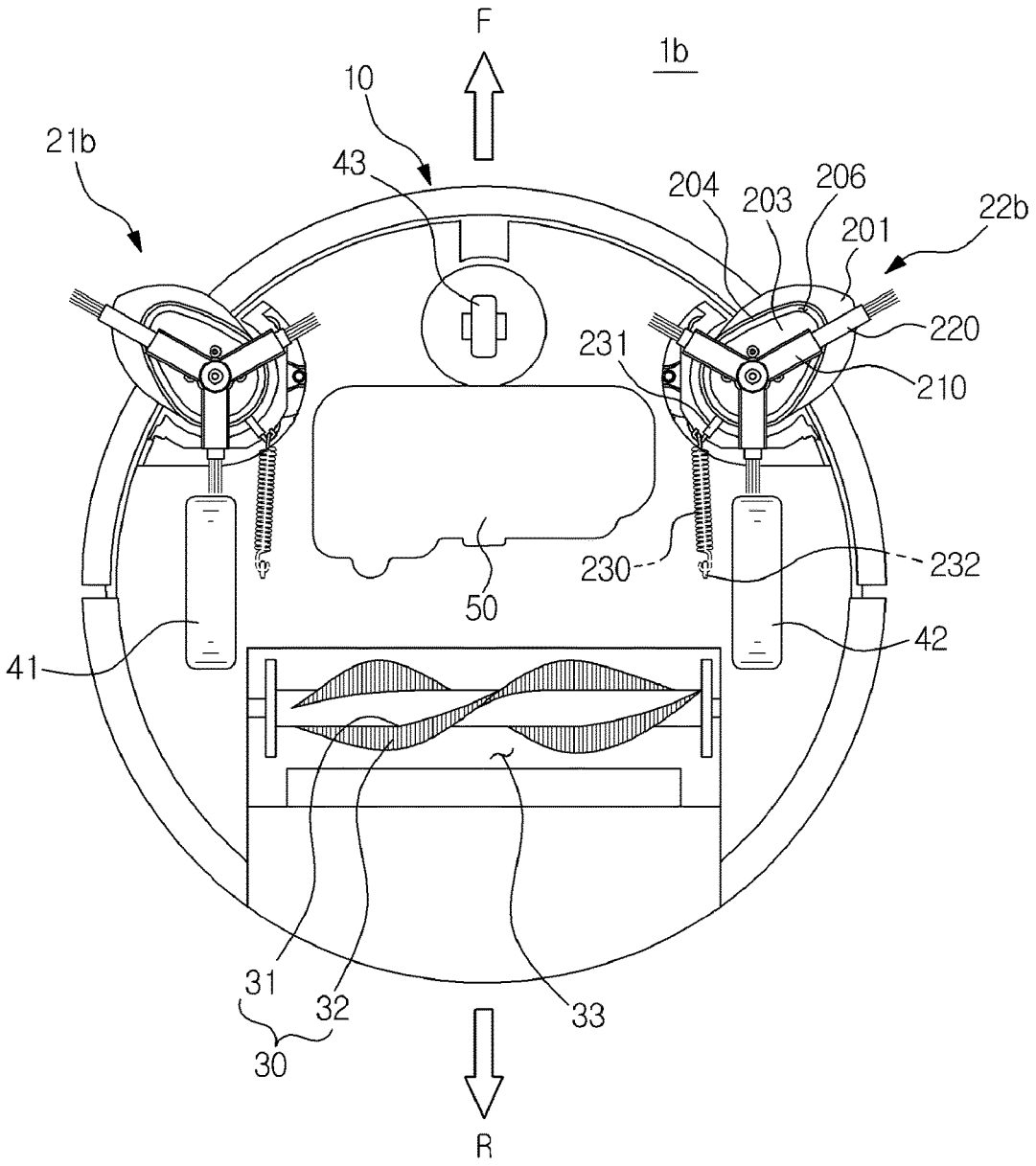
FIG. 7 is a bottom view of a robot cleaner according to another embodiment.
Figure 8:
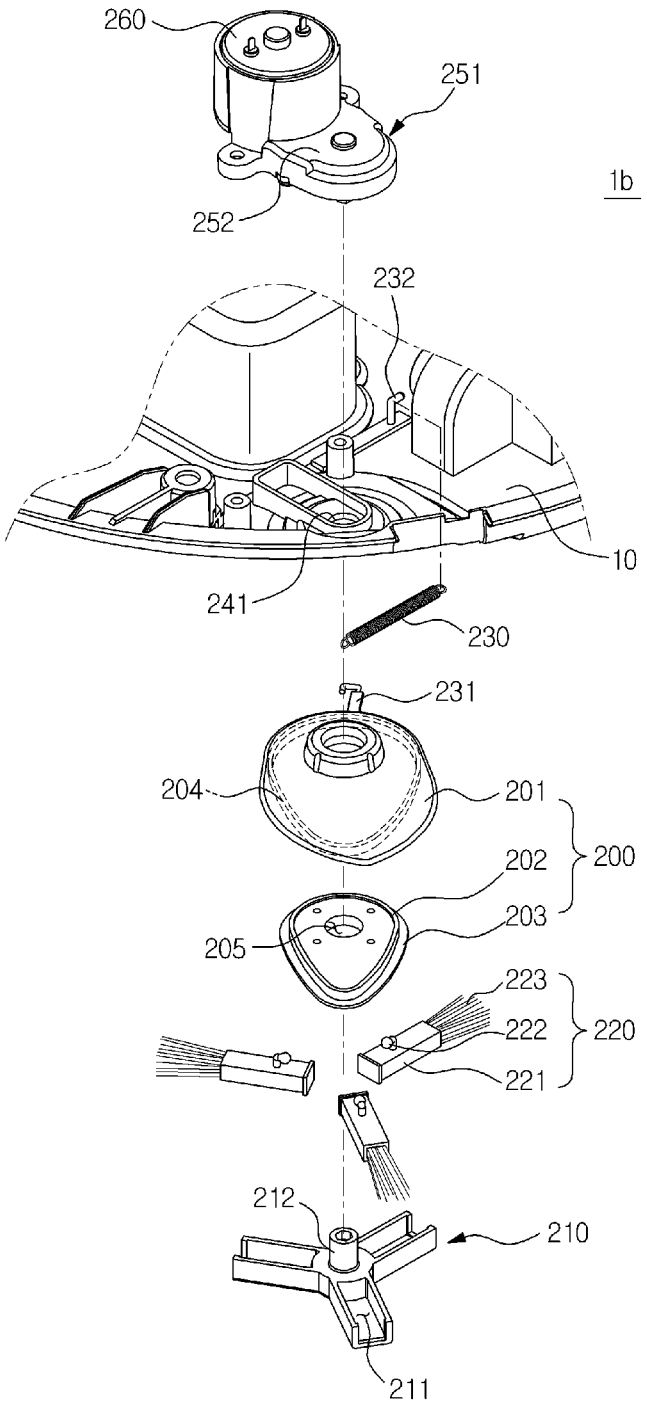
FIG. 8 is a perspective view showing a configuration of a side brush assembly in the robot cleaner of FIG. 7.
Figure 9:
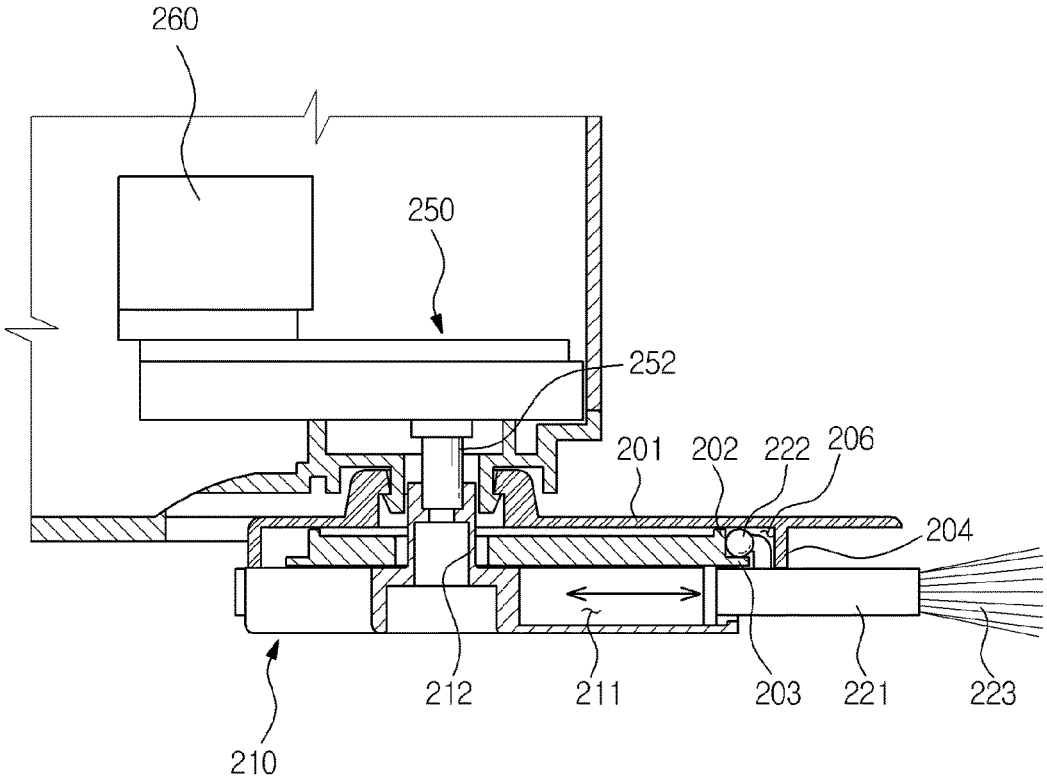
FIG. 9 is a sectional view showing a configuration of a side brush assembly in the robot cleaner of FIG. 7.

As shown in FIGS. 7 to 9, two side brush assemblies 21*b* and 22*b* are mounted at front opposite sides of the main body 10.

A guide body 203 and a guide cover 201 are stacked on an arm holder 210 on which brush units 220 have been mounted. Then, the resulting stack is mounted at one side of the main body 10.

The arm holder 210 is provided with three brush seats 211 that are equal in the number to the brush units 220. That is, three brush units 220 may be seated respectively in the brush seats 211. The brush seats 211 extend outward in a radial direction at a constant angular interval from the center of the arm holder 210.

A holder shaft 212 protrudes from the center of the arm holder 210. The holder shaft 212 serves to transmit power of an arm motor 260 that will be described hereinafter to the arm holder 210 so as to enable rotation of the arm holder 210.

The brush units 220 are respectively seated in the brush seats 211 of the arm holder 210. Each brush unit 220 includes a brush arm 221 configured to secure the brush unit 220 to the arm holder 210, and a brush 223 extending outward from the brush arm 221 with one end thereof received in the brush arm 221.

The brush unit 220 is moved forward and rearward in the brush seat 211 in a longitudinal direction of the brush seat 211 when the arm holder 210 is rotated.

A guide loop 222 is formed at an upper surface of the brush arm 221 to secure the brush arm 221 to a rail 206 that will be described hereinafter, so as to allow the brush arm 221 to perform reciprocal motion along the rail 206 in a predetermined path. The guide loop 222 protrudes upward from the upper surface of the brush arm 221, and has an end bent toward the center of the brush unit 220 where the holder shaft 212 is present. As such, the guide loop 222 generally has a loop shape.

The brush guide 200 includes the guide body 203 and the guide cover 201 to cover the top of the guide body 10.

The guide body 203 has a first through-hole 205, through which the holder shaft 212 of the arm holder 210 passes. The guide body 203 also has an inner rib 202 protruding upward from the edge of an upper surface of the guide body 203.

Similarly, the guide cover 201 has a second through-hole 206, through which the holder shaft 212 of the arm holder 210 passes. The guide cover 204 also has an outer rib 204 protruding downward from the edge of a ceiling surface of the guide body 203. The outer rib 204 is located outward of the inner rib 202. That is, an interior space defined by the outer rib 204 is greater than an interior space defined by the inner rib 202.

Once the guide body 203 and the guide cover 201 have been coupled to each other, the rail 206 is defined between the outer rib 204 and the inner rib 202. The guide loop 222 is reciprocally pivotable in the rail 206.

Once the arm holder 210, on which the brush guide 200 is stacked, has been mounted to the bottom of the main body 10, the holder shaft 212 penetrates the first through-hole 205 and the second through-hole 206 until the end thereof is located close to one side of the lower surface of the main body 10.

A part of the brush guide 200 protrudes outward from the main body 10.

The brush guide 200 according to the present embodiment has a general external appearance of an egg shape. That is, a part of the brush guide 200 located inside the main body 10 is arcuately curved by a large radius of curvature, and the remaining part of the brush guide 200 located outside the main body 10 is arcuately curved by a small radius of curvature. As such, as compared to a circular brush guide, a part of the brush guide 200 may protrude farther outward from the main body 10.

Based on the above described configuration of the brush guide 200, the inner rib 202 and the outer 204 formed at the edges of the guide body 203 and the guide cover 201 have the above described shapes. Moreover, the rail 206 defined between the inner rib 202 and the outer rib 204 also has the above described shape.

Even in the case of brush guides having different shapes from that in the above described embodiment, they may be included within the embodiment of the present invention so long as a part of the brush guide may protrude farther outward from the main body 10. For example, the brush guide having a rounded triangular or elliptical corner is within the embodiments of the present invention.

Additionally, even the brush guide 200 having a circular shape may be within the embodiments of the present invention if the holder shaft 212 penetrates a portion of the brush guide deviated from the center to the edge of the circular brush guide 200 because this deviation causes a part of the brush guide 200 to protrude farther outward of the main body 10.

A holder motor housing 251 in which a holder motor 260 is received is placed on a portion of the main body 10 where the arm holder 210 and the brush guide 200 are mounted.

The holder motor housing 251 is provided with a holder gear receiver 252, in which a holder gear (not shown) is received to transmit power of the holder motor 260 to the arm holder 210. A rotating shaft extending from the holder gear penetrates a third through-hole 241 formed in the main body 10 and is connected to the holder shaft 212 so as to enable rotation of the holder shaft 212 and the arm holder 210.

A loop-shaped first retainer 231 is formed at an outer perimeter of the guide cover 201, and a loop-shaped second retainer 232 is formed at a lower surface of the main body 10. An elastic member 230 is installed between the first retainer 231 and the second retainer 232.

The elastic member 230 elastically biases a part of the brush guide 200 so as to protrude outward. This biasing will be described later with reference to FIG. 12.

Hereinafter, operation of the side brush assemblies 21*b* and 22*b* will be described.

Figure 10:
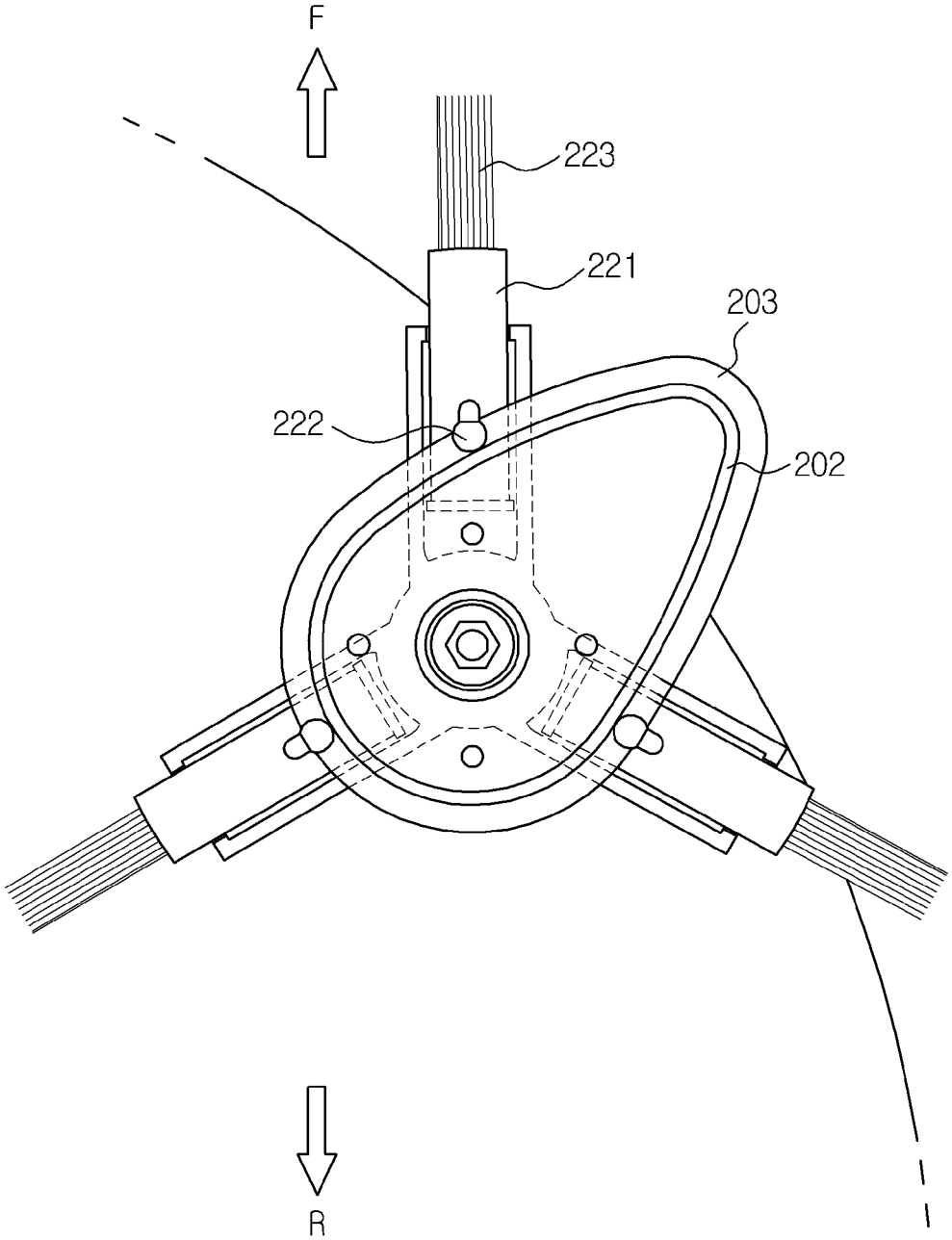
FIGS. 10 and 11 are views showing operation of a side brush assembly in the robot cleaner of FIG. 7.
Figure 11:
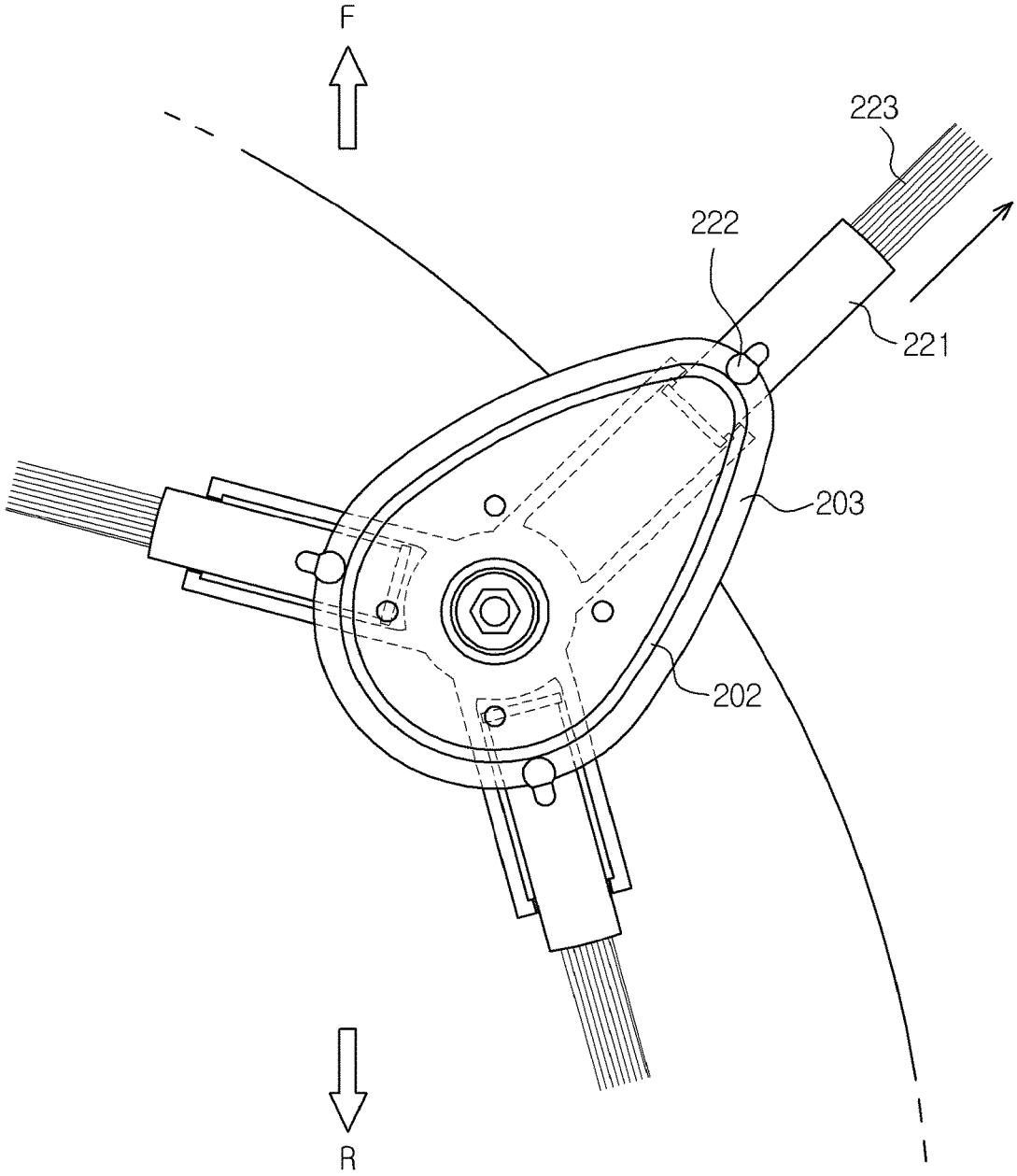

As shown in FIGS. 10 and 11, the arm holder 210 is rotated in place about the holder shaft 212. On the other hand, the brush unit 220 is pivoted along the contour of the brush guide 200 as the guide loop 222 reciprocally moves along the rail 206.

The brush unit 220 is moved forward or rearward in the brush seat 211 by a difference in movement paths between the arm holder 210 that is rotated in place and the brush unit 220 that is moved by the brush guide 200 along the rail 206.

When the brush unit 220 passes a part of the brush guide 200 protruding outward from the main body 10, the brush unit 220 is moved forward in a radial outward direction of the arm holder 210 in the brush seat 211, thereby protruding outward from the main body 10 to the maximum extent. On the contrary, when the brush unit 220 passes a part of the brush guide 200 located inside the main body 10, the brush unit 220 is moved rearward toward the center of the arm holder 210 where the holder shaft 212 is located.

As such, the brush unit 220 may be positioned so as to protrude farther outward from the main body 10 with the above described simplified configuration. The brush unit 220 having an increased protruding length outward from the main body 10 may efficiently sweep dust on the corner of the floor and the area close to the wall toward the main body 10.

Figure 12:
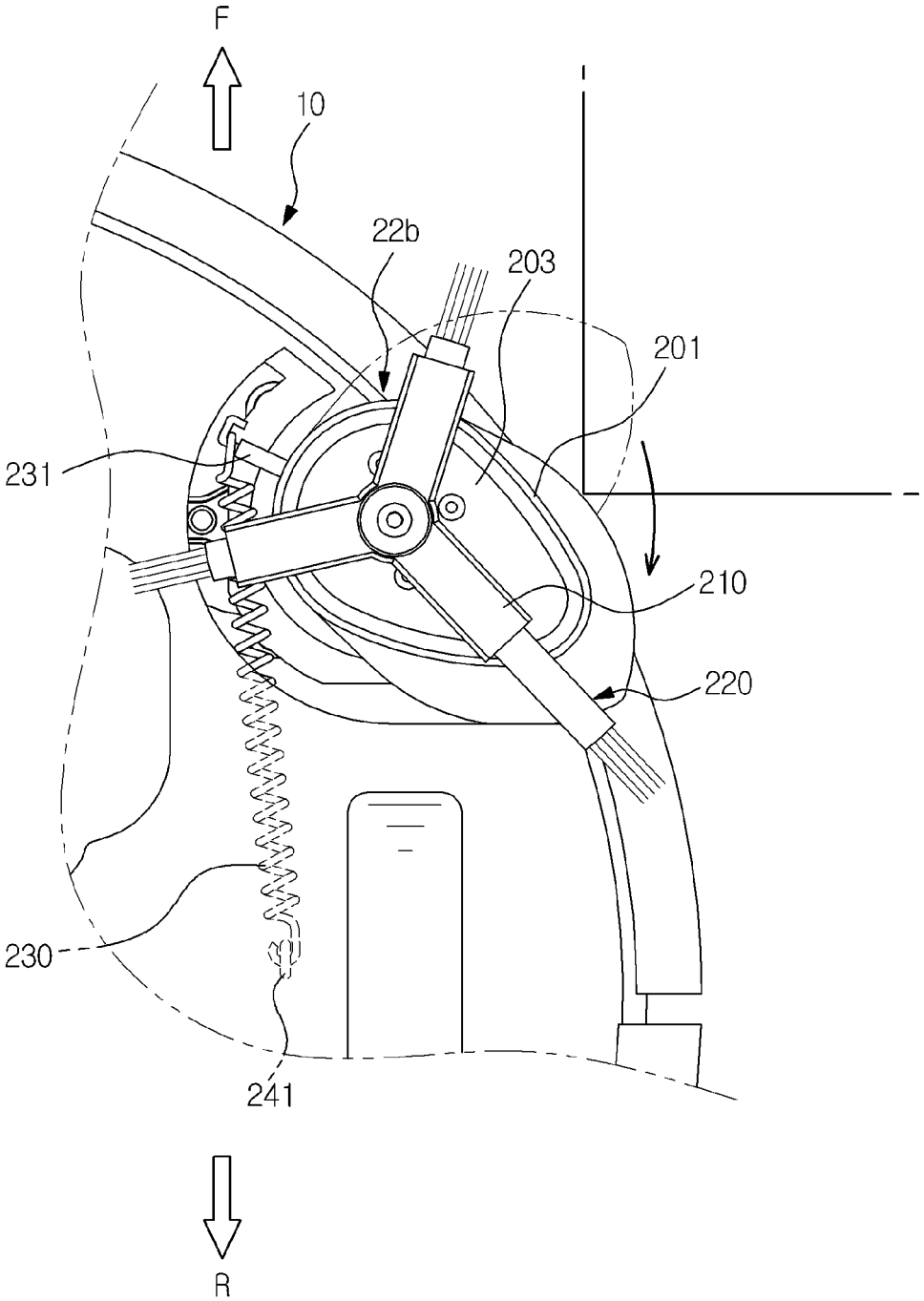
FIG. 12 is a view showing operation of a side brush assembly in the robot cleaner of FIG. 7, when the side brush assembly is in contact with the wall.

As shown in FIG. 12, the brush guide 200 is not secured to the lower surface of the main body 10, but is mounted to be pivotable about the holder shaft 212. However, a part of the guide 200 may remain to protrude outward by the elastic member.

That is, the brush guide 200 is pivotably mounted to the main body 10 under the influence of elasticity of the elastic member 230.

As such, even if a part of the brush guide 200 protruding outward from the main body 10 bumps into an obstacle, the brush guide 200 may be pivoted to avoid the obstacle and may prevent damage thereto.

After the main body 10 is moved forward and completely avoids the obstacle, a part of the brush guide 220 may again protrude outward from the main body 10 by elasticity of the elastic member 230.

A description of overlapped configurations with the firstly described embodiment will be omitted hereinafter.

Figure 13:
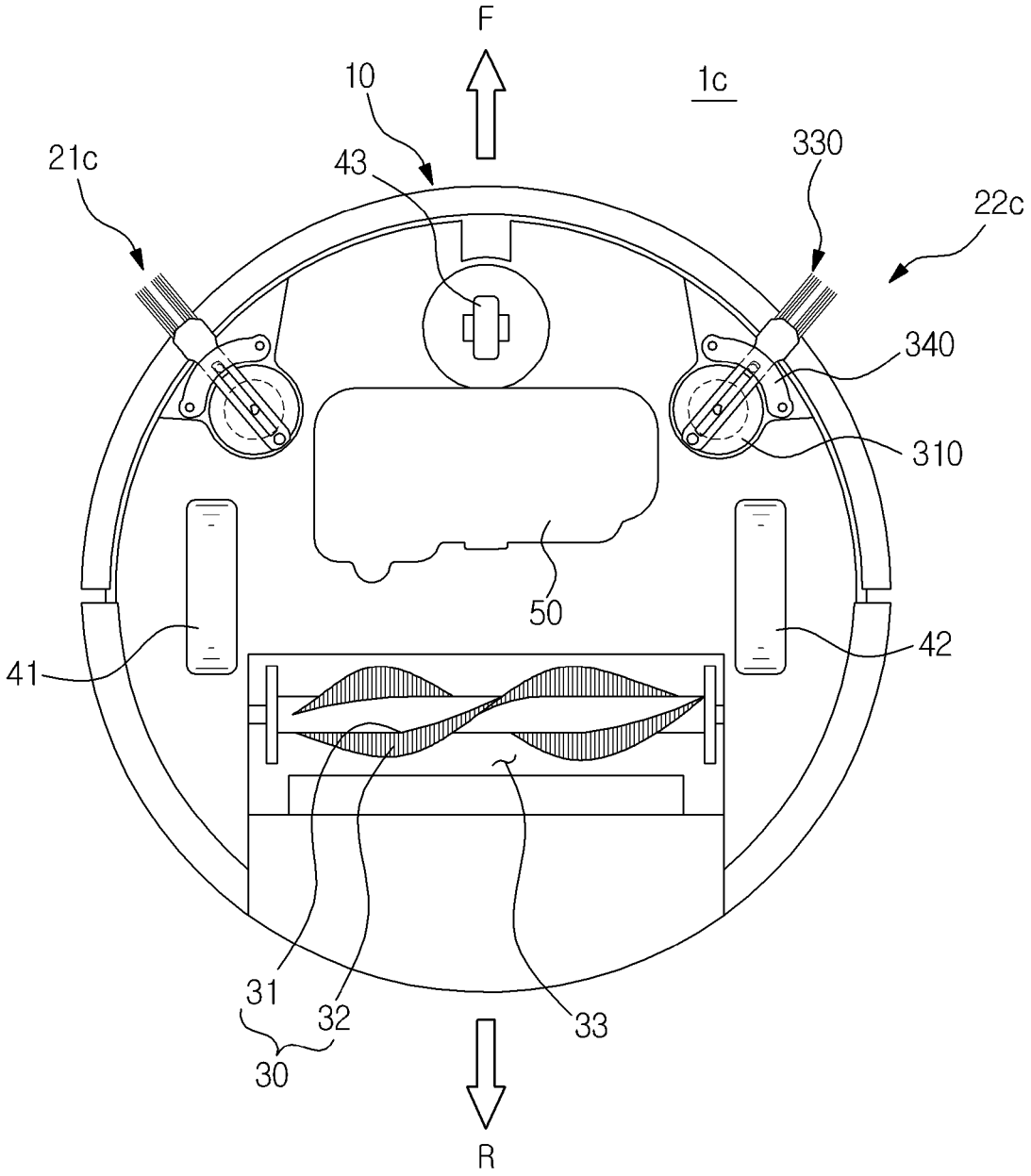
FIG. 13 is a bottom view of a robot cleaner according to a further embodiment.
Figure 14:
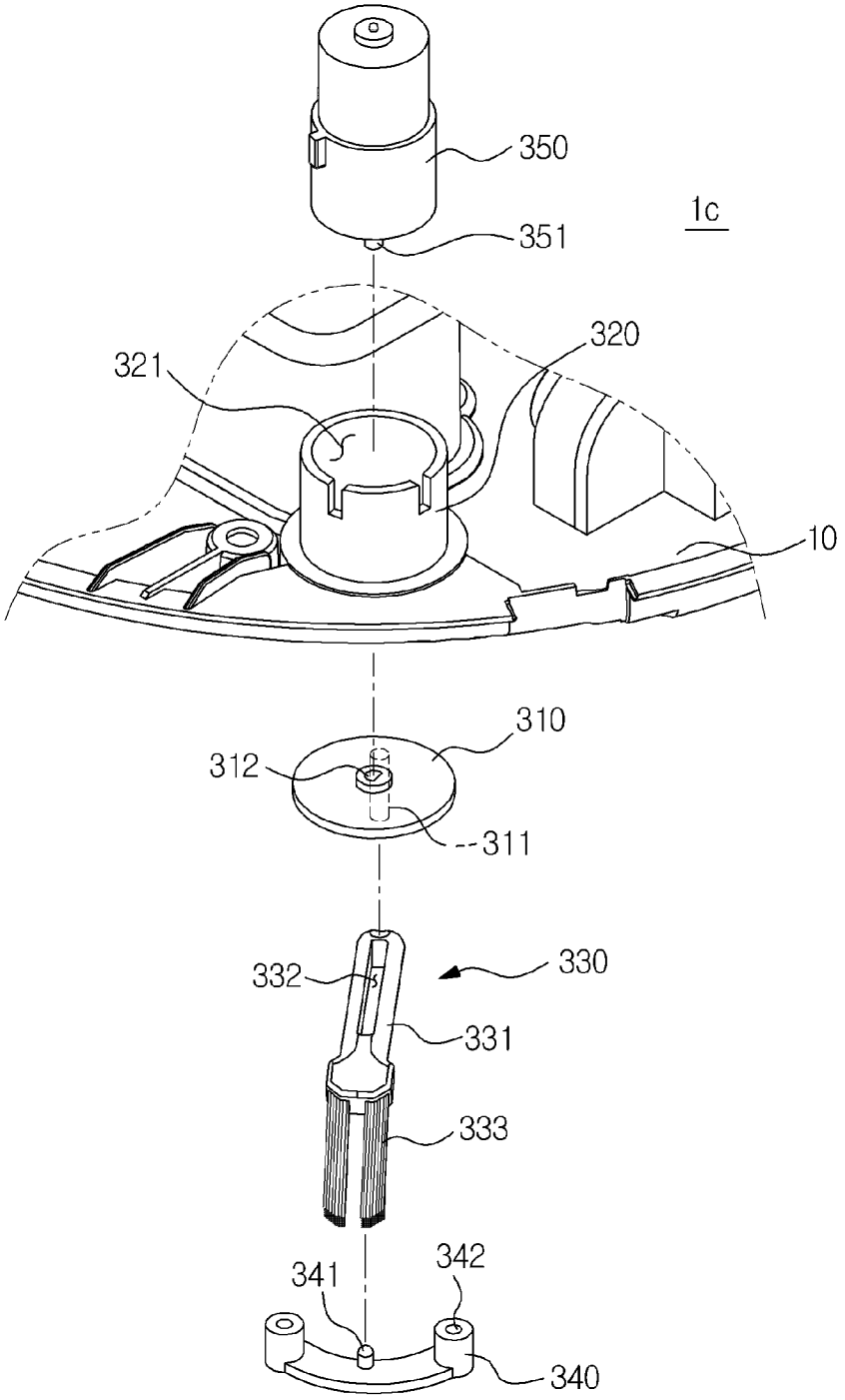
FIG. 14 is a perspective view showing a configuration of a side brush assembly in the robot cleaner of FIG. 13.

As shown in FIGS. 13 and 14, each of side brush assemblies 21*c* and 22*c* includes a rotating plate 310 rotatably mounted to the lower surface of the main body 10, a brush unit 330 pivotally coupled to the rotating plate 310, and a brush guide 340 to guide movement of the brush unit 330.

A motor receiver 320 in which a rotating plate motor 350 to rotate the rotating plate 310 is received is formed at a portion of the main body 10 where the rotating plate 310 is mounted. The motor receiver 320 protrudes upward along the contour of the rotating plate motor 350, and internally defines a seating bore 321 in which the rotating plate motor 350 is received.

A rotating shaft 351 is formed at the bottom of the rotating plate motor 350 received in the seating bore 321 to transmit power of the rotating plate motor 350 to the rotating plate 310. One end of the rotating shaft 351 is connected to the rotating plate motor 350 and the other end of the rotating shaft 351 is fitted into a receiving recess formed at the center of the rotating plate 310. Thereby, power of the rotating plate motor 350 is transmitted to the rotating plate 310 via the rotating shaft 351.

A fixing boss 311 protrudes upward from an upper surface of the rotating plate 310. The fixing boss 311 is fixed to the brush unit 330 such that the brush unit 330 is pivotable by rotation of the rotating plate 310.

The brush unit 330 includes a brush shaft 331 and a brush 333 mounted to one end of the brush shaft 331. A sliding region 332 is formed in the center of the brush shaft 331.

The brush guide 340 is mounted closer to the rim of the main body 10 than the rotating plate 310. The brush guide 340 is located beneath the main body 10 and includes a brush guide support portion and a protrusion 341 protruding from the support portion.

The protrusion 341 is inserted into the sliding region 332 of the brush unit 330 to allow the brush unit 330 to pivot on a fanlike trajectory.

Hereinafter, operation of the side brush assemblies 21*c* and 22*c* will be described.

Figure 15:
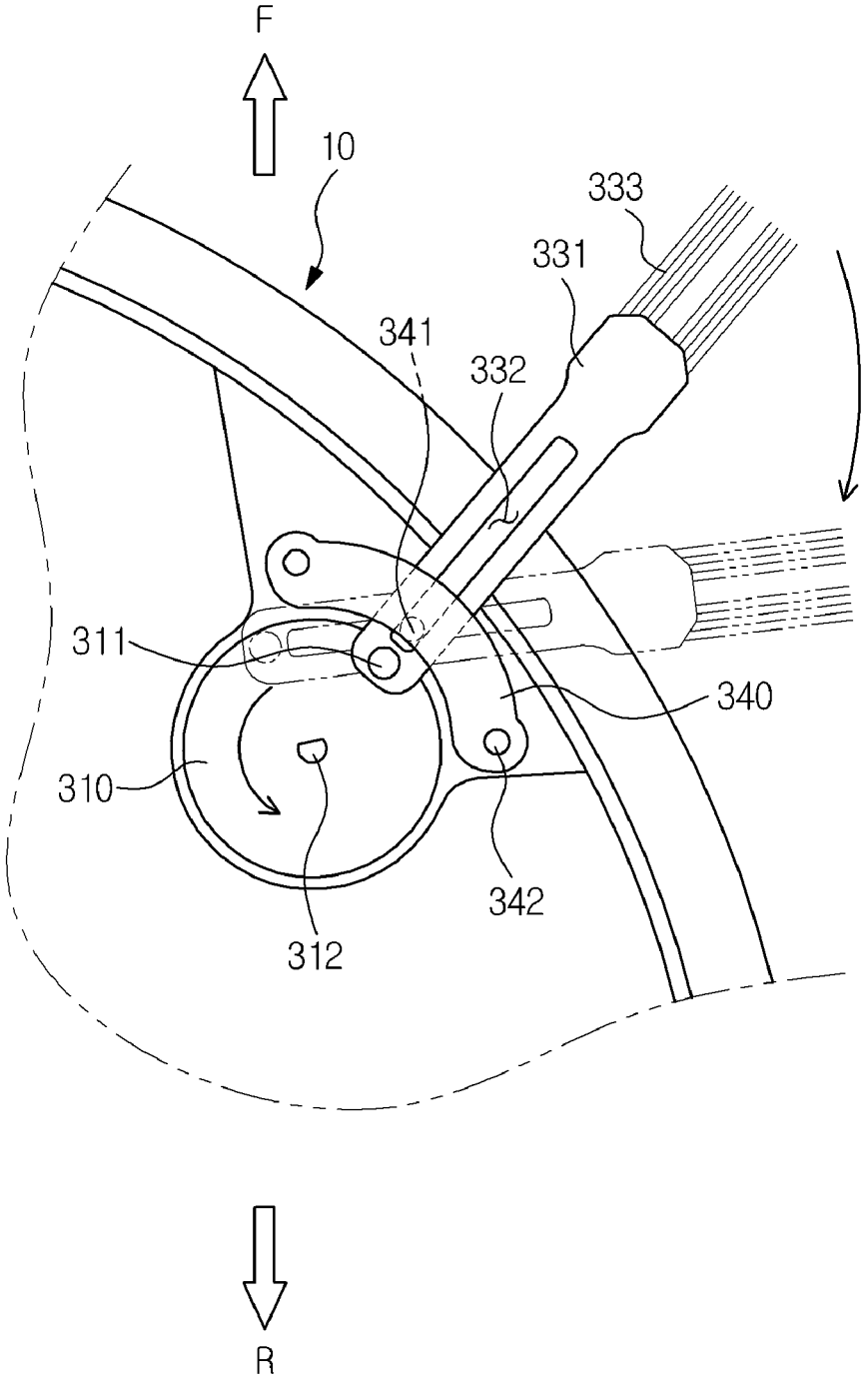
FIGS. 15 and 16 are views showing operation of a side brush assembly in the robot cleaner of FIG. 13.

As shown in FIG. 15, although one end of the brush unit 330 is coupled to the rotating plate 310 to perform rotation, a middle portion of the brush unit 330 is fixed stationary by the protrusion 341 of the brush guide 340. Thus, a portion of the brush unit 330 to which the brush 333 is mounted is moved on a fanlike trajectory.

If the rotating plate 310 is rotated in a state in which the brush unit 330 protrudes outward from the main body 10 to the maximum state, the brush unit 330 is pivoted as designated by a dotted line. With this pivoting, the brush 333 of the brush unit 330 sweeps dust on a place remote from the main body 10 toward the rear R of the main body 10, and simultaneously sweep the dust closer to the main body 10.

Thereby, the dust directed closer to the main body 10 by the brush 333 may be easily suctioned into the main body 10 by the main brush unit (30, see FIG. 2) and a blower (not shown).

Figure 16:
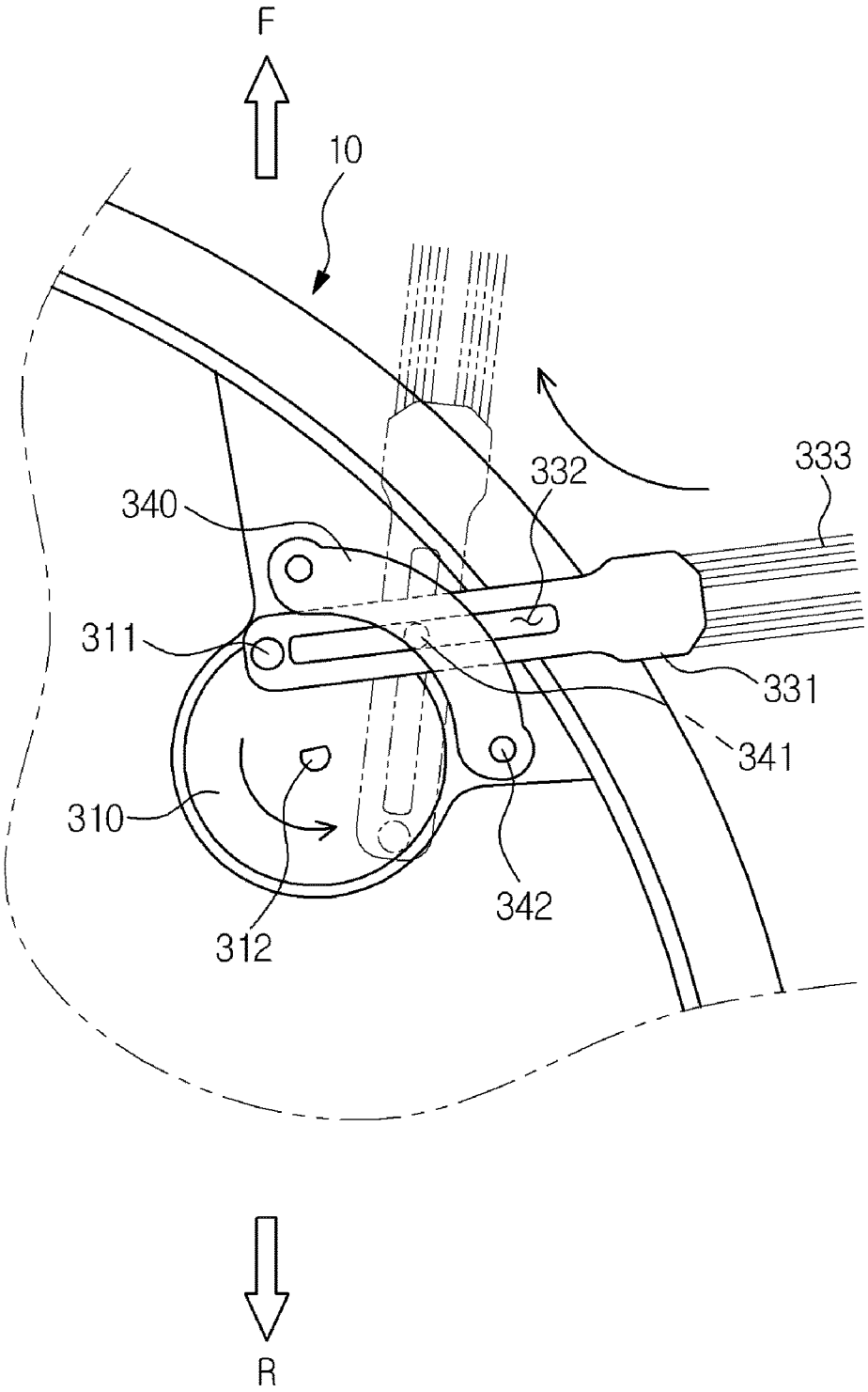

FIG. 16 is a view showing operation of the brush unit 330 subsequent to operation of the FIG. 15.

Although the brush 333 of the brush unit 330 is pivoted from the rear R to the front F of the main body 10 by rotation of the rotating plate 310 as shown in FIG. 16, the brush 333 is pivoted at a position close to the main body 10 as shown in FIG. 15, and therefore does not act to scatter dust distal to the main body 10.

On the other hand, although the brush 333 may sweep dust present close to the main body 10 forward of the main body 10, a majority of the dust present close to the main body 10 has already been suctioned into the main body 10 by the main brush unit (30, see FIG. 2) and the blower (not shown), and thus has less effect on cleaning efficiency.

When analogizing operation of the brush 333 of the brush unit 330 from FIGS. 15 and 16, the entire brush 333 is moved on a fanlike trajectory.

In particular, the brush 333 always sweeps dust from the front F to the rear R of the main body 10 when it sweeps dust distal to the main body 10.

In this way, through use of the simplified configuration, it may be possible not only to clean dust distal to the main body 10, but also to increase cleaning efficiency by sweeping and gathering dust closer to the main body 10.

As is apparent from the above description, a robot cleaner according to the embodiments of the present disclosure may achieve enhanced cleaning performance with respect to an area close to the wall or the corner of the floor.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A robot cleaner comprising:

a main body configured to, when the robot cleaner is positioned on a surface, clean the surface while traveling on the surface, the main body having a lateral surface defining the external appearance of a lateral surface of the robot cleaner; and at least one side brush assembly mountable to the main body, when the robot cleaner is positioned on the surface, to clean at least one of a corner of the surface and a wall extending from the surface, wherein the side brush assembly includes:

a side arm pivotably coupled to the main body, the side arm movable between a first position where the side arm is inserted into the main body and a second position where the side arm protrudes outward from the lateral surface of the main body, a brush unit provided at the side arm, when the robot cleaner is positioned on the surface, to sweep the at least one of the corner of the surface and the wall extending from the surface and brush the dust to a center of the main body, and a rim cover coupled to the side arm to form a part of the lateral surface of the main body when the side arm is inserted into the main body.

2. The robot cleaner according to claim 1, wherein the side arm is pivotable when the main body comes close to the at least one of the corner of the surface and the wall extending from the surface, thereby protruding outward from the lateral surface of the main body to the second position.

3. The robot cleaner according to claim 1, wherein the side brush assembly further includes an arm motor provided at an end of the side arm to pivot the side arm.

4. The robot cleaner according to claim 1, wherein the brush unit includes:

a rotator mountable to an end of the side arm to enable pivoting of the side arm, and a plurality of brushes extending outward in a radial direction from the rotator.

5. The robot cleaner according to claim 4, wherein the brush unit further includes a brush motor provided at the end of the side arm to enable a rotation of the rotator.

6. The robot cleaner according to claim 1, wherein, when the robot cleaner is positioned on the surface and when one side of the main body comes close to the wall, the side arm of the side brush assembly closest to the wall protrudes outward from the lateral surface of the main body to move to the second position.

7. The robot cleaner according to claim 1, wherein, when the robot cleaner is positioned on the surface and when a front end of the main body on a basis of a traveling direction comes close to the wall, the side arm of the at least one side brush assembly located at the front end of the main body protrudes outward from the lateral surface of the main body to move to the second position.

8. A robot cleaner comprising:

a main body configured to, when the robot cleaner is positioned on a surface, clean the surface while traveling on the surface, the main body having a lateral surface defining an external appearance of a lateral surface of the robot cleaner, and an opening formed in the lateral surface; and a plurality of side brush assemblies arranged at opposite sides of a front surface of the main body on a basis of a traveling direction of the robot cleaner when the robot cleaner is positioned on the surface, wherein the plurality of side brush assemblies each includes:

a side arm pivotably coupled to the main body, the side arm movable through the opening of the main body between a position where the side arm is insertable into the main body and a position where the side arm protrudes outward from the lateral surface of the main body, a brush unit provided at the side arm, when the robot cleaner is positioned on the surface, to sweep at least one of a corner of the surface and a wall extending from the surface and brush the dust to a center of the main body, and a rim cover configured to cover the opening when the side arm moves to the position where it is inserted into main body.

9. The robot cleaner according to claim 8, wherein, when the robot cleaner is positioned on the surface and the main body comes close to the at least one of the corner of the surface and the wall extending from the surface, the side arm is pivotable to the position where the side arm protrudes outward from the lateral surface of the main body, and the rim cover opens the opening of the main body.

10. The robot cleaner according to claim 9, wherein the plurality of side brush assemblies includes a left side brush assembly provided at a left side of the front surface of the main body, and a right side brush assembly provided at a right side of the front surface of the main body.

11. The robot cleaner according to claim 10, wherein, when the robot cleaner is positioned on the surface and when one side of the main body comes close to the wall, the side arm of one side brush assembly closest to the wall among the left side brush assembly and the right side brush assembly moves to the position where the side arm protrudes outward from the lateral surface of the main body.

12. The robot cleaner according to claim 10, wherein, when the robot cleaner is positioned on the surface and when a front end of the main body comes close to the wall, the side arm of each of the left side brush assembly and the right side brush assembly moves to the position where the side arm protrudes outward from the lateral surface of the main body.

13. The robot cleaner according to claim 1, wherein the axis about which at least one brush of the brush unit is rotatable being substantially perpendicular to the surface on which the robot cleaner is positioned.

14. The robot cleaner according to claim 8, wherein the axis about which at least one brush of the brush unit is rotatable being substantially perpendicular to the surface on which the robot cleaner is positioned.

* * * * *